United States Patent [19]

Yang et al.

[11] Patent Number: 5,024,293

[45] Date of Patent: Jun. 18, 1991

[54] EMERGENCY LADDER EQUIPMENT

[76] Inventors: Anthony Yang; Victor Yang, both of 1594 Travois Cir., Las Begas, Nev. 89119

[21] Appl. No.: 462,179

[22] Filed: Jan. 8, 1990

[51] Int. Cl.[5] ..... E06C 9/06

[52] U.S. Cl. ..... 182/93; 182/106; 182/156; 182/105; 182/197

[58] Field of Search ..... 182/195, 197, 198, 70, 182/76, 106, 93, 156

[56] References Cited

U.S. PATENT DOCUMENTS

| | | | |
|---|---|---|---|
| 375,107 | 12/1887 | Thelem | 182/197 |
| 406,765 | 7/1889 | Parry | 182/197 |
| 2,534,202 | 12/1950 | McCall | 182/195 |
| 3,444,958 | 5/1969 | McCall | 182/195 |
| 3,464,517 | 9/1969 | Akermanis | 182/195 |
| 3,871,479 | 3/1975 | Pelto | 182/195 |
| 3,946,833 | 3/1976 | Riehlmann | 182/195 |
| 3,997,026 | 12/1976 | Riehlmann | 182/195 |
| 4,211,306 | 7/1980 | Brenner | 182/106 |
| 4,232,761 | 11/1980 | Phillips | 182/195 |
| 4,476,957 | 10/1984 | Ory | 182/195 |

*Primary Examiner*—Reinaldo P. Machado
*Attorney, Agent, or Firm*—Jordan and Hamburg

[57] ABSTRACT

The present invention discloses an emergency ladder equipment. Such an emergency ladder equimpment is mounted on the outside wall of the top floor of buildings. The emergency ladder equipment substantially comprises a number of ladder members which are stored in a storage case in a stacked or folded manner except for an emergency case, wherein the storage case is mounted on the outside wall of buildings. Each ladder member is connected by a connecting device to the subsequent ladder member. Furthermore, the bottom end of each ladder member is supported by a support stay disposed in the storage case. By releasing the support stay, each ladder member slides down one after another in series while being connected by a plurality of connecting devices to form a complete ladder which is installed along the outside wall of the building.

3 Claims, 16 Drawing Sheets

EMERGENCY LADDER EQUIPMENT

STATE OF ART

This invention relates to an emergency ladder equipment.

BACKGROUND OF INVENTION

When a fire breaks out in a high-rise building or apartment complex, people usually use emergency stairs to escape therefrom since it is difficult for them to find fire-proof shelters inside.

Therefore, in general, these buildings are equipped with emergency stairs or emergency ladders on the outer surface of their walls.

These conventional emergency stairs, however, have the following drawbacks in terms of prompt installing or assembling of the stairs (e.g. raising or suspending ladders) on the outer surface of the walls in case of an emergency.

One of such drawbacks is the fact that the structure of the ladders is complicated. Accordingly, the operation of such ladders is eventually considerably complicated.

Another drawback may be that, in order to use ladders from each floor, it is necessary to have the same number of ladders as the number of floors. It has been difficult, however, to install such a large number of ladders on the outer surface of the wall in terms of installation cost.

To avoid or obviate such drawbacks, one ladder structure which is installed close to the window of a building and is vertically extended from the top to the bottom of the building may be considered. Such ladder construction, however, is dangerous for people climbing down the ladder, because, in a fire, they may be injured by the smoke and flame blowing out from the windows.

Accordingly, it is an object of the present invention to provide an emergency ladder equipment which can overcome the above-mentioned drawbacks of conventional ladders or stairs.

SUMMARY OF INVENTION

In summary, this invention discloses an emergency ladder equipment comprising a plurality of ladder members which form a complete ladder by being suspended one after another, a storage case storing a plurality of ladder members under a stacked condition, which is mounted on an uppermost portion of an outside surface of a wall of a building, a plurality of ladder connecting devices, each of which connects the bottom end of each preceeding ladder member and the top end of each succeeding ladder member in a vertical direction, and a plurality of support stays which are capable of supporting the bottom ends of respective ladder members and releasing the supporting thereof by a suitable releasing means, whereby, by releasing the supporting of the bottom ends of the ladder members, the first ladder member is slid down from the storage case and ensuing or subsequent ladder members are slid down one after another from the storage case so as to be suspended by means of the ladder connecting devices to form an elongated complete ladder structure.

Furthermore, this invention discloses an emergency ladder equipment in which the emergenncy ladder is provided with a spacing device which is operated automatically corresponding to the sliding of the ladder member to provide a space between the ladder member and the outside surface of a wall of a building.

Still furthermore, this invention discloses an emergency ladder equipment in which the emergenncy ladder is provided with a safety guard device which can surround the back of a man climbing down the ladder so as to secure the safety of the man.

In this invention, ladder members are stacked together in a storage case which is usually mounted on the top portion of the outside surface of the wall of a building. Each ladder member is supported longitudinally on the corresponding support stay.

In an emergency, when each support stay is released by operating a suitable means such as an operating wire which can be pulled from each window, all the ladder members slide down one after another and by means of a plurality of ladder connecting devices, each ladder member is suspended respectively from the subsequent or ensuing ladder member disposed above to form a complete ladder structure on the outside surface of the wall of the building. In order that each ladder member slides down one after another, the device for releasing the support stays for the ladder member is readily operated from each floor, and people can escape safely from a fire.

Furthermore, with the provision of the spacing device disposed between the ladder and the outside surface of the wall of the building, a sufficient space is provided therebetween. Such a spacing device is operated automatically when the ladder members slide down. Accordingly, people can take hold their bodies away from the outside surface of the wall. Since the ladder can lean against the wall of the building by way of the spacing device, the spacing device can reinforce the structure of the ladder thereby providing the ladder with safety in terms of structure thereof as well.

The safety guard devices also improve safety of a man climbing down the ladder since they surround the back of the man.

The advantages brought about by the ladder structure of this invention are as follows.

(a) Since the ladder according to this invention is installed on or suspended from the outside surface of the wall of a building while assuring a sufficient space from the window, people can escape from the building safely even in a situation where smoke and flames go out from windows.

(b) Since the emergency ladder is constructed in a collapsible construction and is extended to be formed into a complete ladder construction only in case of emergency, a small space is sufficient for storing the ladder when not in use.

(c) The spacing devices and safety guard devices are both automatically operated as the ladder members slide down. Accordingly, without using any particular means, people can readily and safely escape from the building on fire.

BEST MODE FOR CARRYING OUT THE INVENTION

The embodiments of this invention will be described in detail in view of the attached drawings.

Figure 2:
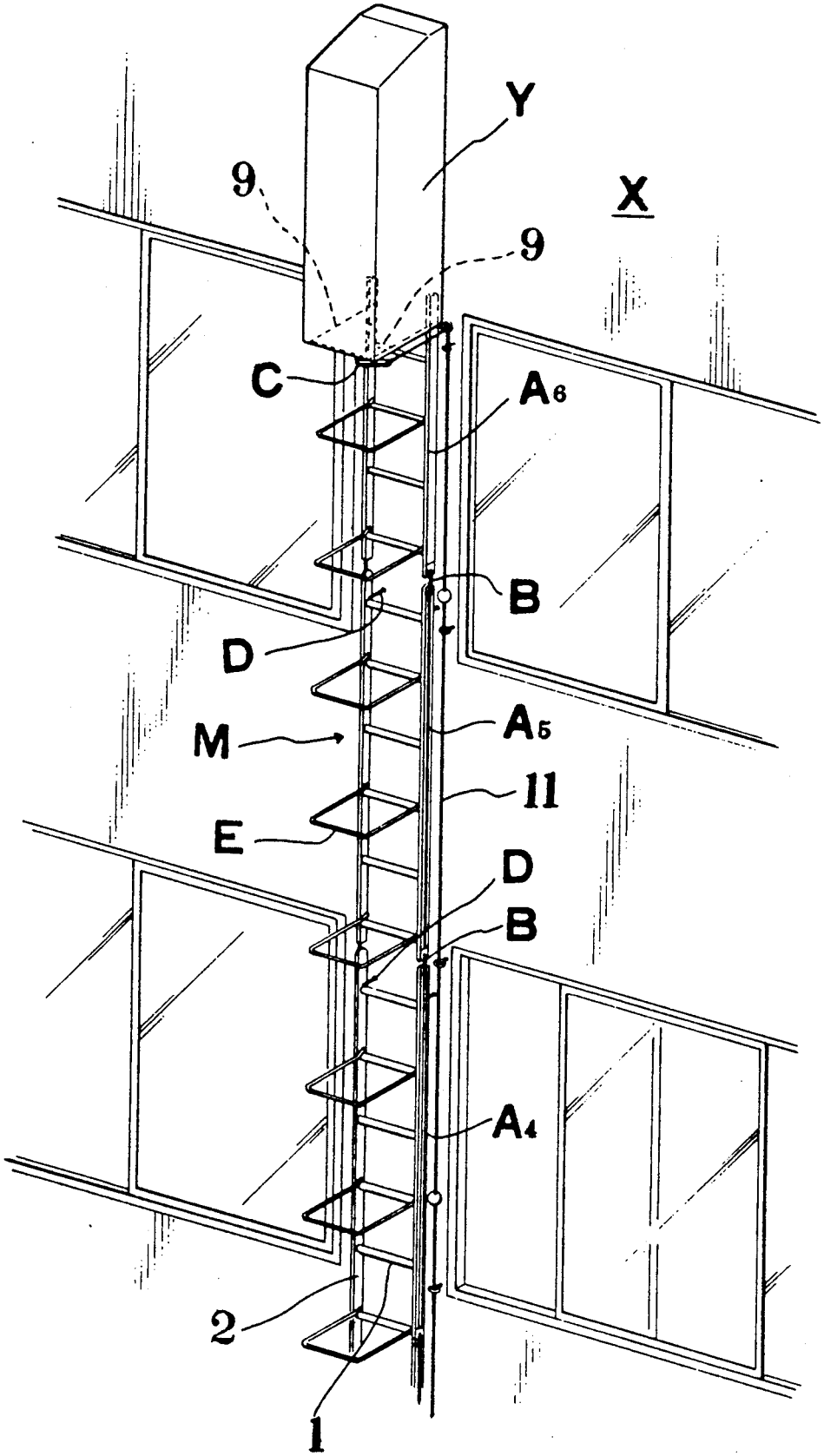
FIG. 2 is a perspective view showing a condition where ladder members are extended to form a complete ladder.
Figure 11:
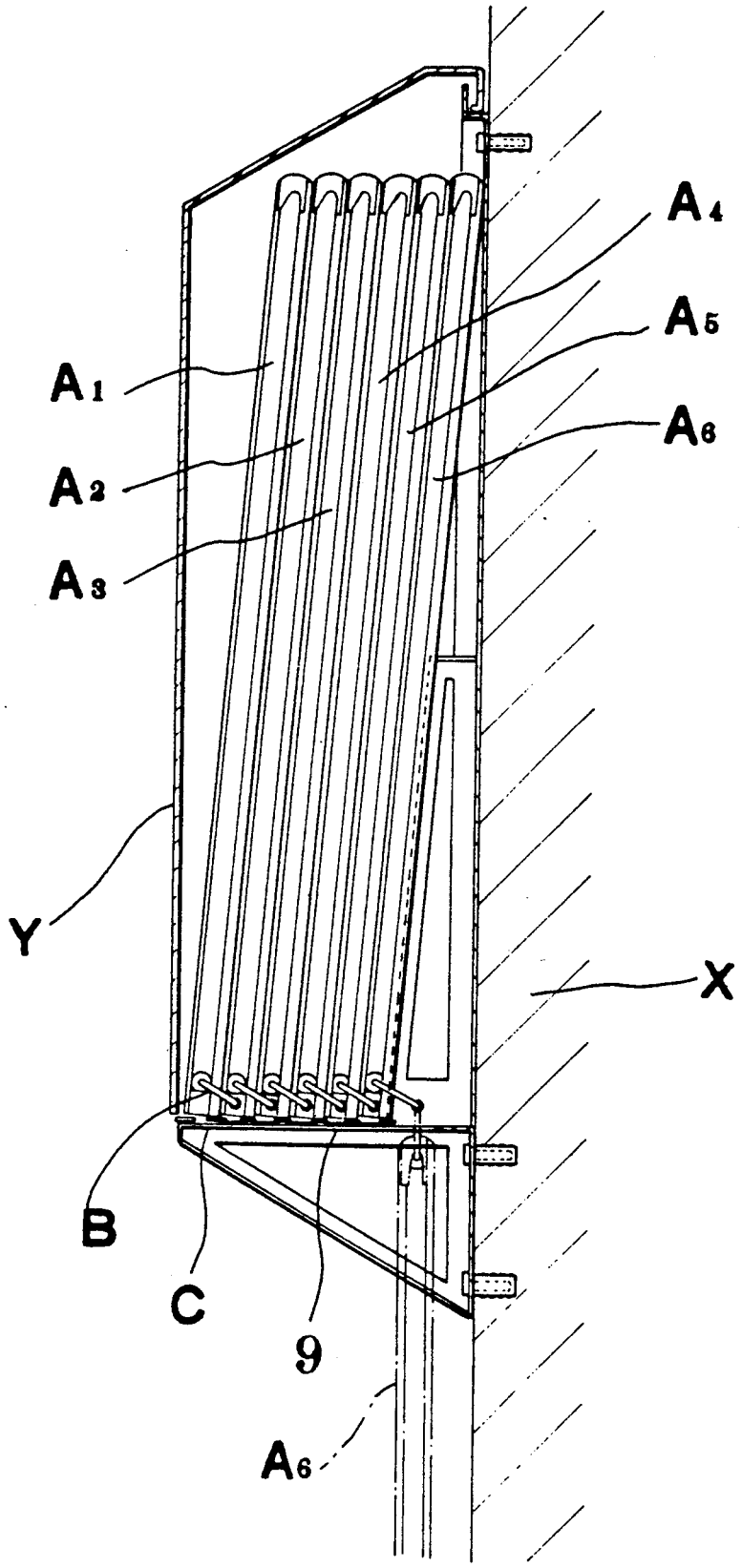
FIG. 11 is a sectional side view showing a condition where ladder members are stored in a storage case.

As shown in FIGS. 2 and 11, an emergency ladder equipment of this invention is shown and such a ladder equipment substantially comprises a plurality of ladder members $A_1$ to $A_6$ (the number being equal to the number of floors in a building X), a plurality of ladder connecting devices B connecting the ladder members $A_1$ to $A_6$ in series, a supporting device C supporting and storing ladder members $A_1$ to $A_6$ in a storage case Y when not in use and releasing the ladder members $A_1$ to $A_6$ to be extended downwardly in an emergency case, a plurality of spacing devices D providing a space between the ladder members $A_1$ to $A_6$ and an outside wall x of a building X when in use, and a safety guard device E capable of surrounding the back of a person so as to prevent him or her from falling down from the emergency ladder equipment.

The construction of respective devices A, B, C, D, or E of the above-mentioned emergency ladder structure is explained hereinafter in detail.

Figure 1:
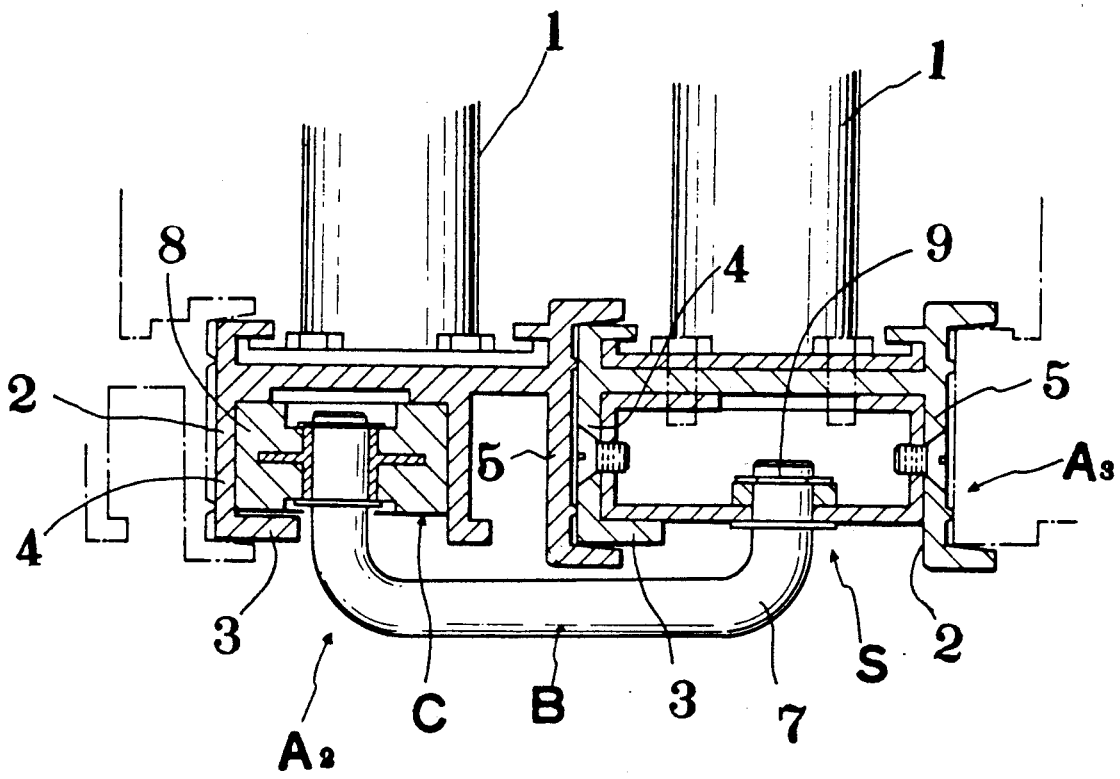
FIG. 1 is a cross sectional view taken along the line I—I of FIG. 4 showing the structure of right-side portions of the stacked ladder members according to this invention.
Figure 4:
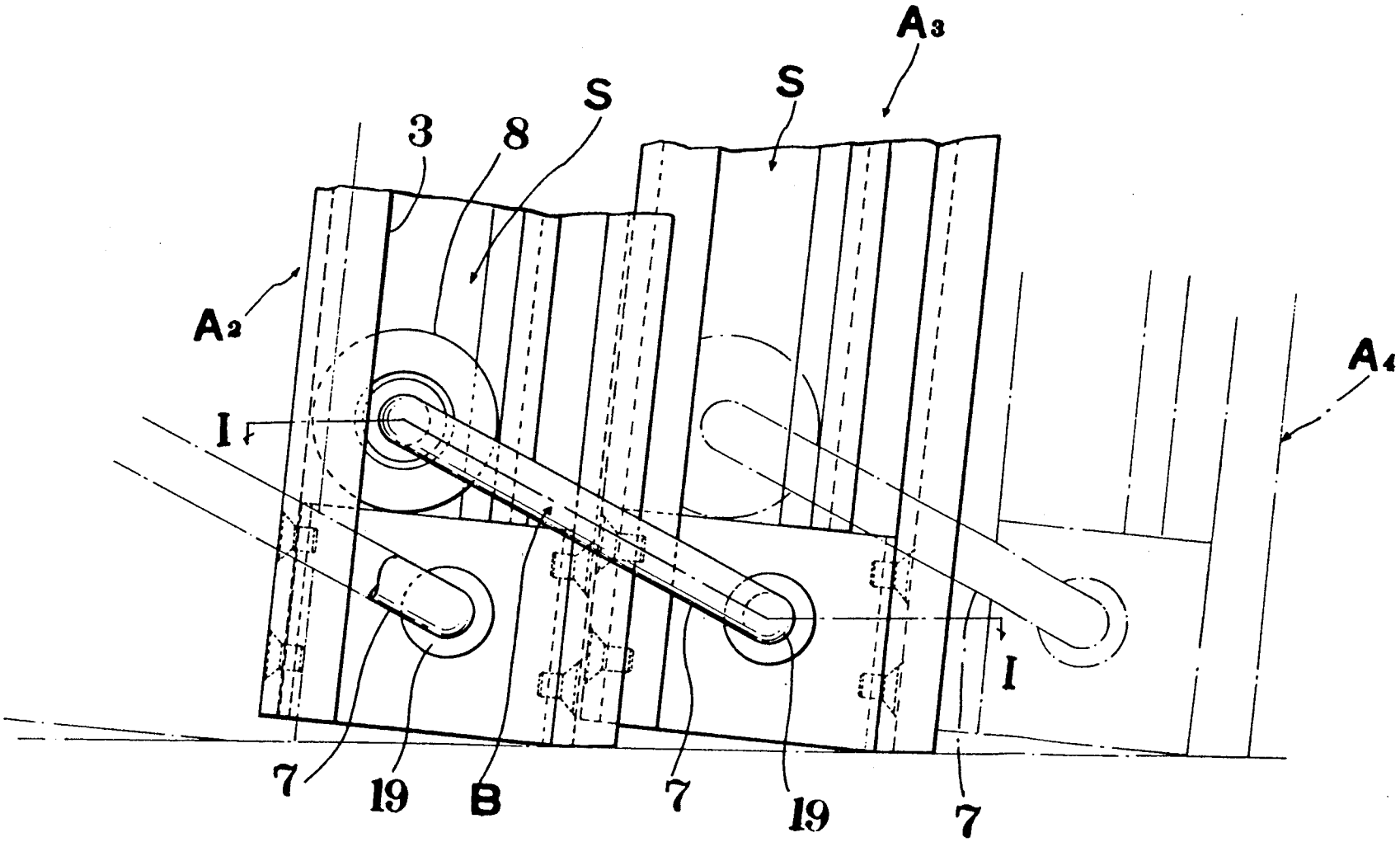
FIG. 4 is a side view partly showing the stacked ladder members and the ladder connecting devices for connecting ladder members.

As shown in FIG. 1, FIG. 2 and FIG. 4, each ladder member $A_1$, $A_2$ . . . , $A_6$ comprises a pair of parallelly-spaced-apart longitudinal ladder sections 2,2 and a plurality of rungs 1 which are bridged between ladder sections 2,2 at regular intervals in a longitudinal direction.

Each succeeding ladder member (for example, $A_3$) has a portion thereof slidably disposed in the preceeding ladder member $A_2$. To be more specific, as shown in FIG. 1, a front section 4 of the succeeding ladder member $A_3$ is slidably accomodated or received in a U-shaped sliding guide 5 of the preceeding ladder member $A_2$. Accordingly, the preceeding ladder member $A_2$ slides down in the succeeding ladder member $A_3$. In the same manner, all other remaining ladder members $A_2$ to $A_6$ also slide down one after another. Since all these ladder members $A_1$ to $A_6$ are connected in series by a plurality of connecting devices B which will be described later in detail, all the ladder members $A_1$ to $A_6$ are vertically aligned in series to form a complete ladder M as shown in FIG. 2.

As can be readily understood from FIG. 1, the U-shaped sliding guide 5 of the preceeding ladder member $A_2$ has enough width to accomodate the the front section 4 of the succeeding ladder member $A_3$.

In FIG. 1, numeral 3 indicates a brim of the opening formed at the end of the front section 4 of each ladder member $A_1$, $A_2$ . . . , $A_6$.

Figure 6:
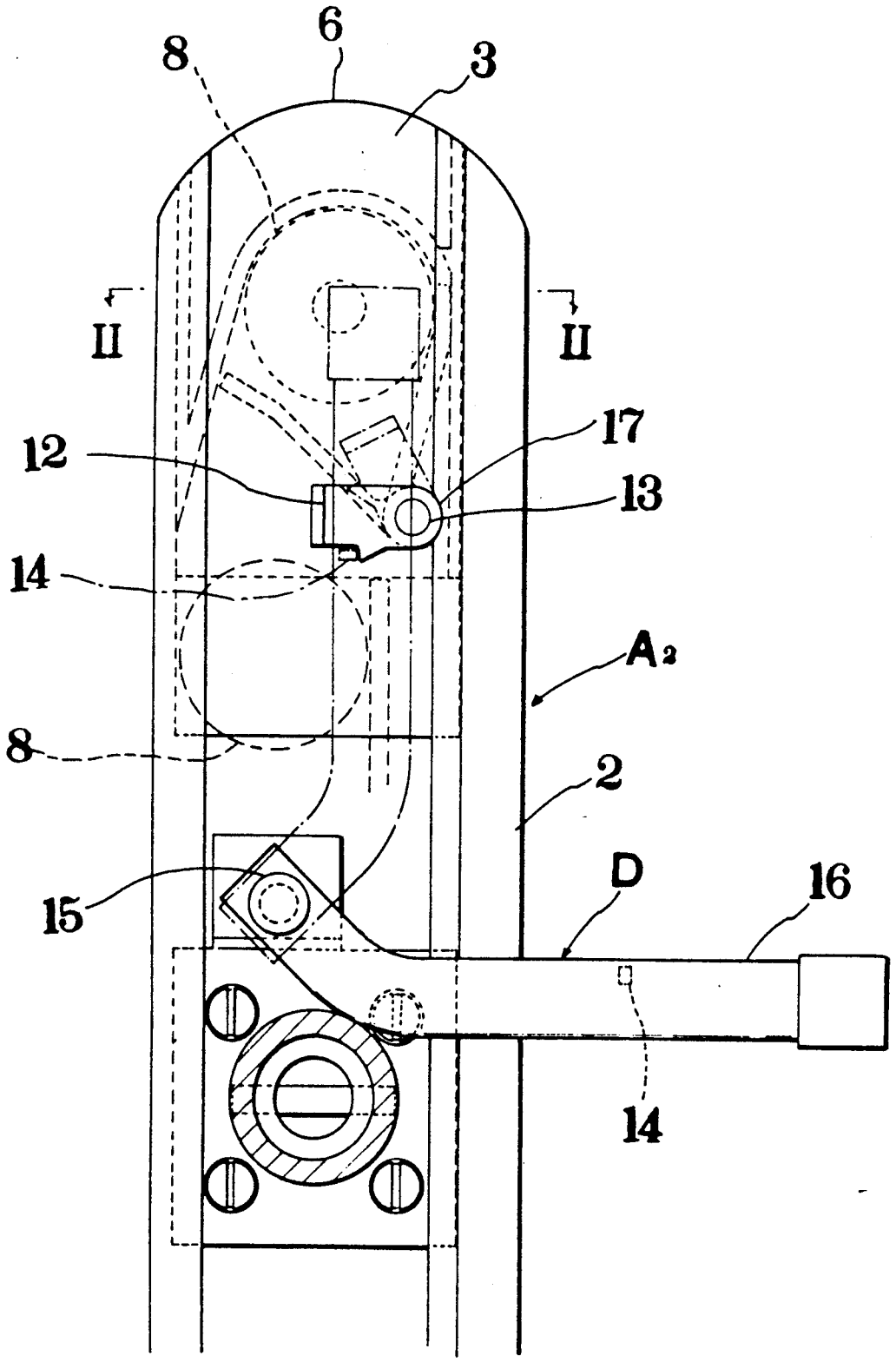
FIG. 6 is a side view showing a spacing device in an operated position.
Figure 7:
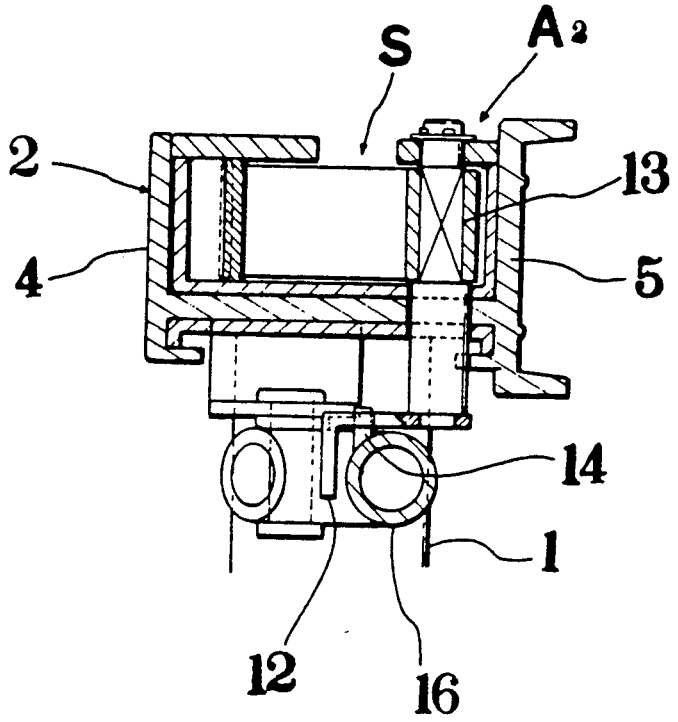
FIG. 7 is a cross sectional view taken along the line II—II of FIG. 6.
Figure 10:
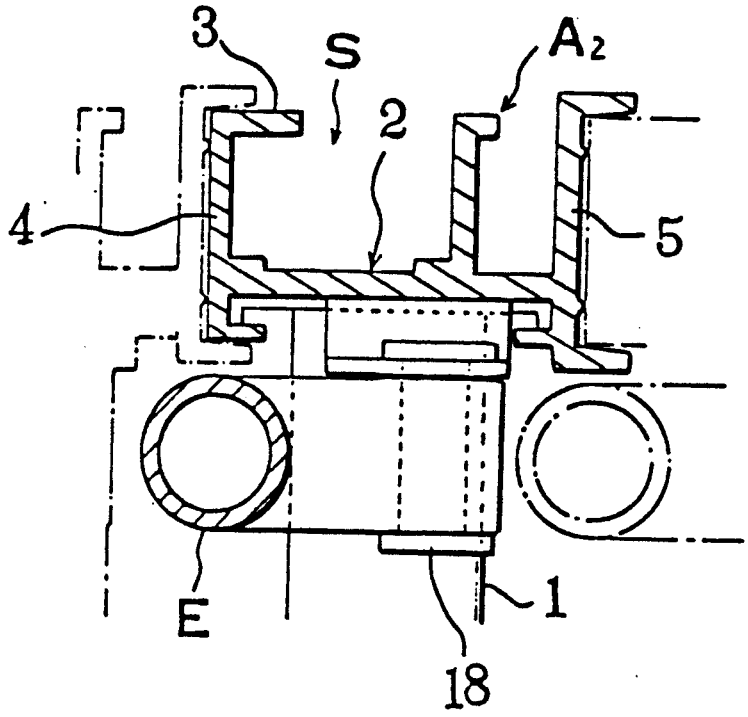
FIG. 10 is a cross sectional view taken along the line III—III of FIG. 9.

As shown in FIG. 6, the top portion of the ladder section 2 of the ladder member (for example $A_2$) has a semicircular shape, and an end opening 2*a* of the top portion of the ladder section 2 is provided with a semicircular plate 6 so as to close the end opening 2*a*.

The ladder connecting devices B which connect ladder members A each other when they slide down have a following construction.

As shown in FIG. 1 and FIG. 4, each ladder connecting device B substantially comprises a U-shaped connector 7 and a support roller 8 which is rotatably mounted on one end of the U-shaped connector 7. The other end of the connector 7 is pivoted by a shaft 19 to the side of the bottom end of the ladder member (for example $A_3$) which is disposed under an uppermost ladder member.

The support roller 8 is, as shown in FIG. 4, slidably held inside the ladder section 2 of the preceeding ladder member $A_2$ and is capable of rolling upwardly along the brim 3 of the opening corresponding to the relative slide-down movement of the preceeding ladder member $A_2$, and finally, is rested inside the semicirular plate 6 which is positioned at the top of the ladder section 2 of the preceeding ladder member $A_2$.

In this manner, each preceeding ladder member is vertically suspended from the succeeding ladder member one after another by a plurality of ladder connecting devices B along the outside surface of the wall of the building, wherein each ladder connecting device B is made of the U-shaped connector 7, the support roller 8 and the pivot shaft 19, respectively.

Next, the storage device Y and the supporting device C are explained in view of attached drawings.

As shown in FIG. 2, the storage case Y is installed on the outer surface of the wall x of the building X with a space provided between the storage case Y and the windows W on the wall of the uppermost floor of the building X. Except for an emergency, all the ladder members $A_1$ to $A_6$ are stored in the storage case Y in a stacked condition.

The supporting device C is provided for supporting the bottom ends of the ladder members $A_1$ to $A_6$ in the storage case Y.

In an emergency, the supporting device C is operated from the window of the building X so as to release the supporting device C from the previous ladder-supporting position. As the bottom ends of the ladder members $A_1$ to $A_6$ loses the support of the supporting device C, each ladder member $A_1$, $A_2$ . . . , $A_6$ slides down one after another from the storage case Y along the outside surface of the wall x of the building X, thereby finally forming a complete ladder M as mentioned above.

Figure 5:
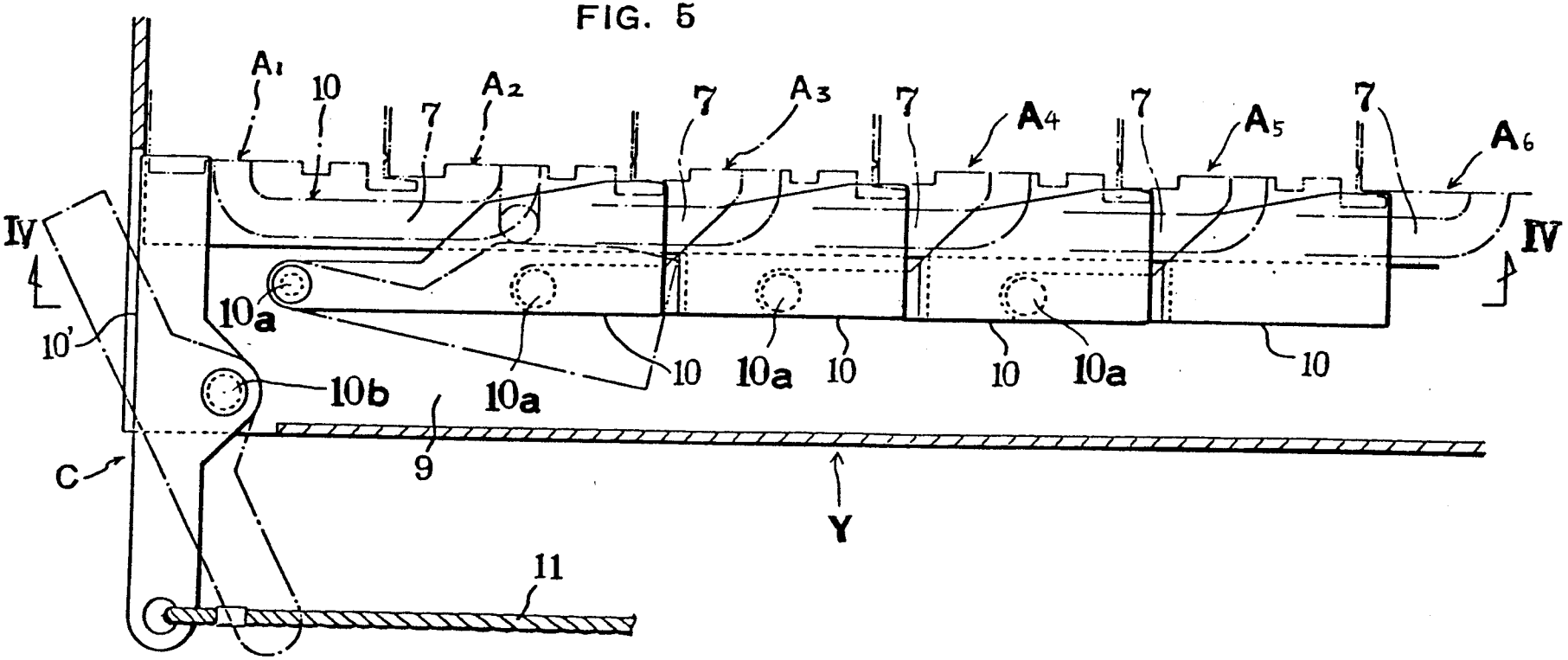
FIG. 5 is a plan view of a ladder member support device.
Figure 5A:
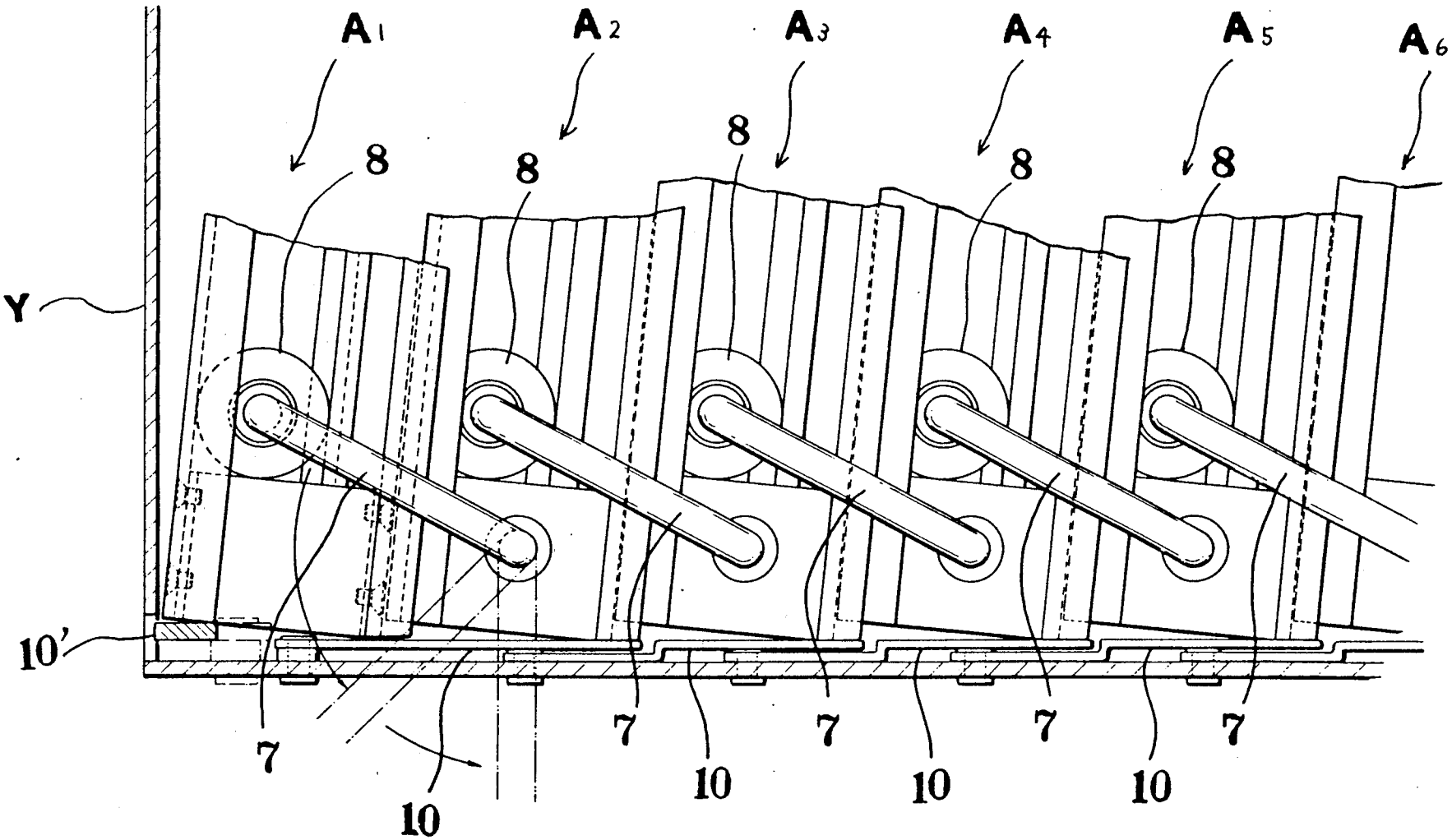
FIG. 5*a* is a cross sectional side view of the ladder member taken along the line IV—IV of FIG. 5.

As concretely shown in FIG. 5 and FIG. 5A, the bottom of the storage case Y is open to define a bottom opening L. A pair of support arms 9 which have the proximal ends thereof fixedly attached to the outer surface of the wall x of the building X have the distal end thereof projected toward the bottom opening L.

On each arm 9, a plurality of support stays 10, the nubmber of which is the same as the number of the ladder members $A_1$, $A_2$ . . . , $A_6$ are pivotally mounted by a plurality of shafts 10*a* at a suitable interval in a direction away from the outer surface of the wall x of the building X. Each support stay 10 is swingable in a direction transverse to the projecting direction of the support arms 9, wherein, in one swinged position, one end of each support stay 10 supports the bottom of the ladder section 2 of the ladder members $A_1$, $A_2$ . . . , $A_6$. In this manner, each ladder member $A_1$, $A_2$ . . . , $A_6$ is supported in the storage case Y by the support stays 10 projected from the outside surface of the wall x of the building X.

Furthermore, a pair of frontmost support stays 10' which are pivotally mounted by shafts 10*b* on the distal end of the support arms 9 for supporting the frontmost ladder member $A_1$ are disposed perpendicular to other support stays 10.

One end of such a frontmost support stay 10' is extended transversely out from the storage case Y and, to such an end, an operating wire 11 which is pulled by a man who wants to escape in an emergency to operate the collapsible ladder is connected.

In addition, after the frontmost or first ladder member $A_1$ slides down by operating the first or frontmost support stay 10', the succeeding ladder member $A_2$ and other ladder members $A_3$, $A_4$ . . . , $A_6$ slide down one after another. Such a mechanism of sliding-down one after another is mentined later.

Figure 3:
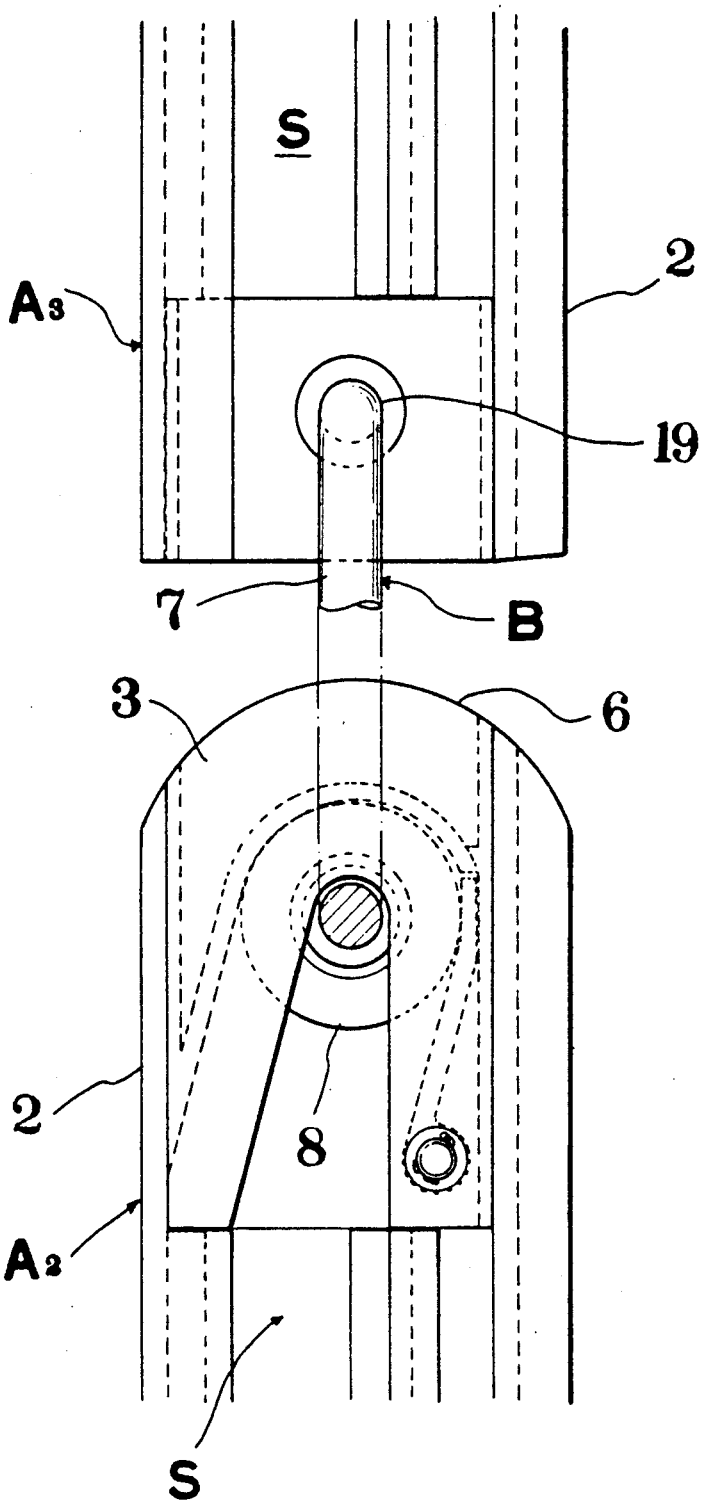
FIG. 3 is an enlarged view partly showing a condition where two ladder members are connected by a ladder connecting device.

When the ladder members $A_1$, $A_2$ . . . , $A_6$ slide down one after another, the support roller 8 of each ladder connecting device B efficiently guides the sliding-down movement of the the ladder members $A_1$, $A_2$ . . . , $A_6$ and finally as shown in FIG. 2 and FIG. 3, each preceeding ladder member is suspended by the succeeding ladder member respectively in succession by means of the ladder connecting devices B.

The manner in which each preceeding ladder (for example $A_2$) is vertically connected with the succeeding ladder member (for example $A_3$) by the ladder connecting device B is further described in detail.

The bottom end of the ladder section 2 of the succeeding ladder member $A_3$ is provided with a pivoted end of the U-shaped connector 7, while the top of the ladder section 2 of the precceeding ladder member $A_2$ is provided with the support roller 8 pivotally mounted to the end of the U-shaped connector 7, and the bottom end of the upper ladder sectin 2 of the succeeding ladder member $A_3$ and the top of the lower ladder section 2 of the precceeding ladder member $A_2$ are connected respectively by means of the ladder connecting device B.

The following is the detailed description of the mechanism for enabling the successive lowering of ladder members $A_1$, $A_2$ . . . , $A_6$.

As shown in FIG. 5 and FIG. 5*a*, when the first or frontmost ladder member $A_1$ slides down by swinging the first support stay 10' away from the storage case Y, the second ladder member $A_2$ and other ladder members $A_3$, $A_4$ . . . , $A_6$ slide down automatically one after another.

Namely, when the operating wire 11 is pulled, the first or frontmost support stay 10' is rotated on the pivoted shaft 10*b* and one end thereof is removed from the bottom end of the ladder section 2 of the first ladder member $A_1$ and the first ladder member $A_1$ slides down. When the first ladder member $A_1$ gets suspended by the ladder connecting device B to the second ladder member $A_2$, the U-shaped connector 7 is rotated downwardly and stood vertically against the support stay 10 of the second ladder member $A_2$ and transversely pushes away this support stay 10 which supports the bottom of the second ladder member $A_2$. Accordingly, the bottom of the adjacent ladder member $A_2$ loses the supporting of the support stay 10 and falls down sliding along the other ladder member A.

The above-mentioned operation is automatically continued until the final ladder member $A_6$ slides down to form the complete ladder M as shown in FIG. 2.

The construction and manner of operation of the spacing device D is explained hereinafter.

As shown in FIG. 2, a space is formed between the outside wall x of the building X and each suspended ladder members $A_1$, $A_2$ . . . , $A_6$ by means of the spacing device D after the complete ladder M is constructed.

When a man who rides on the complete ladder M for escaping from the building X, a considerable amount of his weight is considered to be received by the outside wall x of the building X by way of the spacing device D. Accordingly, the spacing device D provides not only a safety space between the complete ladder M and the outside wall x for protecing the man from the fire or smoke blowing out from the window but also reinforcing the strength to the ladder members $A_1$, $A_2$ . . . , $A_6$.

To explain the construction of the spacing device D in more detail, as shown in FIG. 6, a stopper 12 is pivotally mounted on the top end of the ladder section 2 of each ladder member (for example $A_2$), and the lower end of the stopper 12 is engageable with a projection 14 mounted on the side of the spacer 16 which forms a part of the spacer device D.

The spacers 16 are pivotally mounted on the top ends of the the left and right ladder sections 2 of each ladder member.

As shown in FIG. 6, the spacers 16 are able to take horizontal position by the weight thereof from the vertical position where the ladder member is leaned against the outside wall keeping the space between the outside wall x and the ladder member A. Numeral 15 indicates an end of the spacer 16 pivoted to the ladder section 2.

Except for a case of emergency, the stopper 12 is biased to be engaged with an engaging portion 14 by a spring 17 to be erected perpendicularly.

In this position, the preceding ladder member $A_2$ slides down, and the support roller 8 moves to the top of the ladder section 2 and touches the stopper 12 to disengage with the engaging portion 14 of the spacer 16 as a trip device. When the engaging portion 14 is disengaged from the stopper 12, the spacer 16 is rotated to a horizontal position by the gravity or weight thereof and takes a position to provide a sufficient space between the outside wall x of the building X and the ladder members $A_1$ to $A_6$.

The construction and manner of operation of the safety guard device E is described hereinafter.

The safety guard device E is provided for preventing a man climbing down the complete ladder M from falling down.

Figure 8:
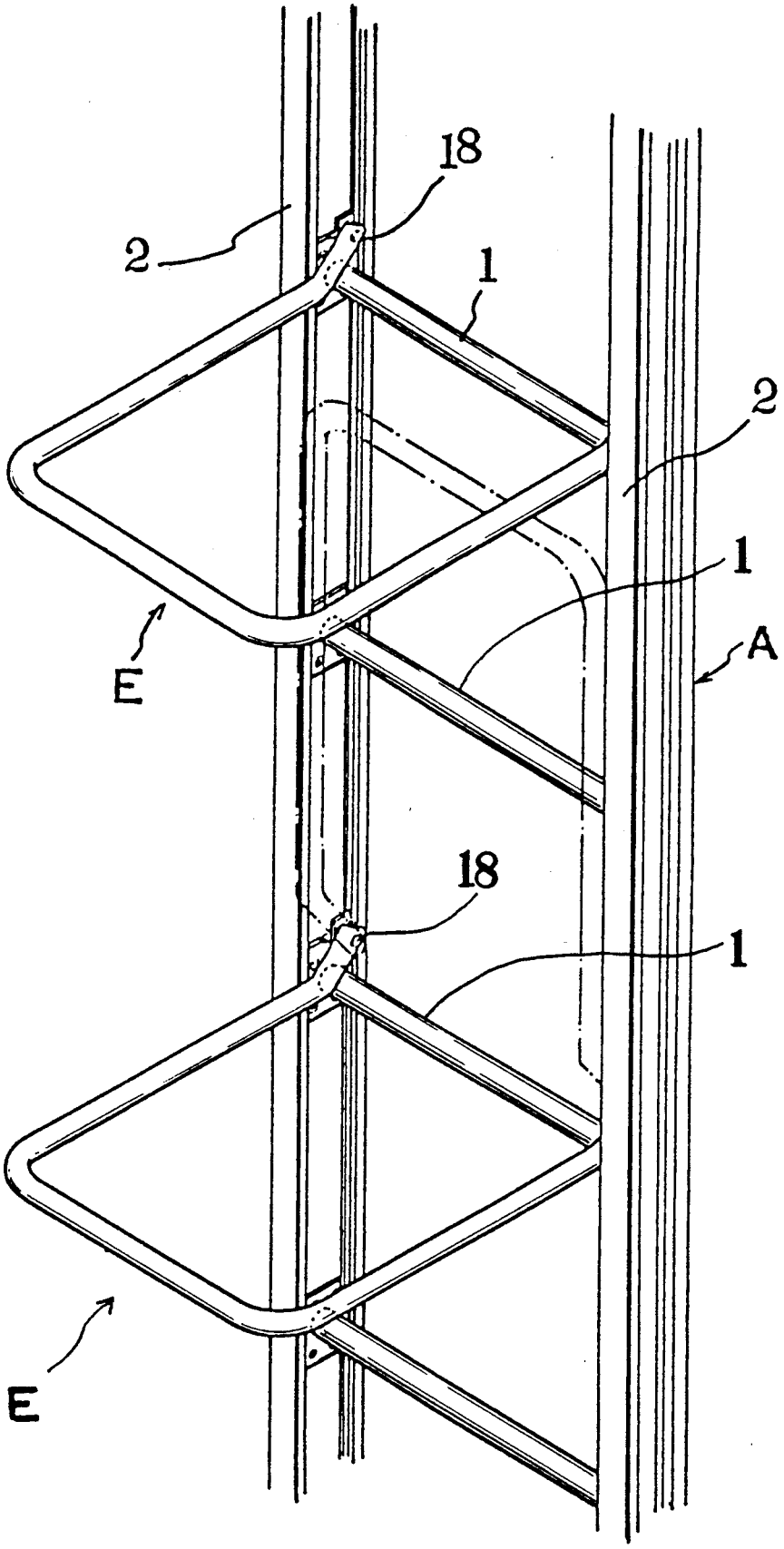
FIG. 8 is a perspective view showing a safety guard device in an operated position.

As shown in FIG. 8, the U-shaped safety guard device E has the both ends thereof pivotally mounted on a pair of mounting plates 18, 18 which are fixedly secured to the ladder sections 2 of each ladder member (for example $A_2$) respectively. Except for an emergency, as shown in FIG. 8 and FIG. 9 with a phantom line, the safety guard device E is aligned along the ladder sections 2 without bias since each ladder member $A_1, A_2 \ldots, A_6$ is stacked in a vertically slanted manner.

Figure 9:
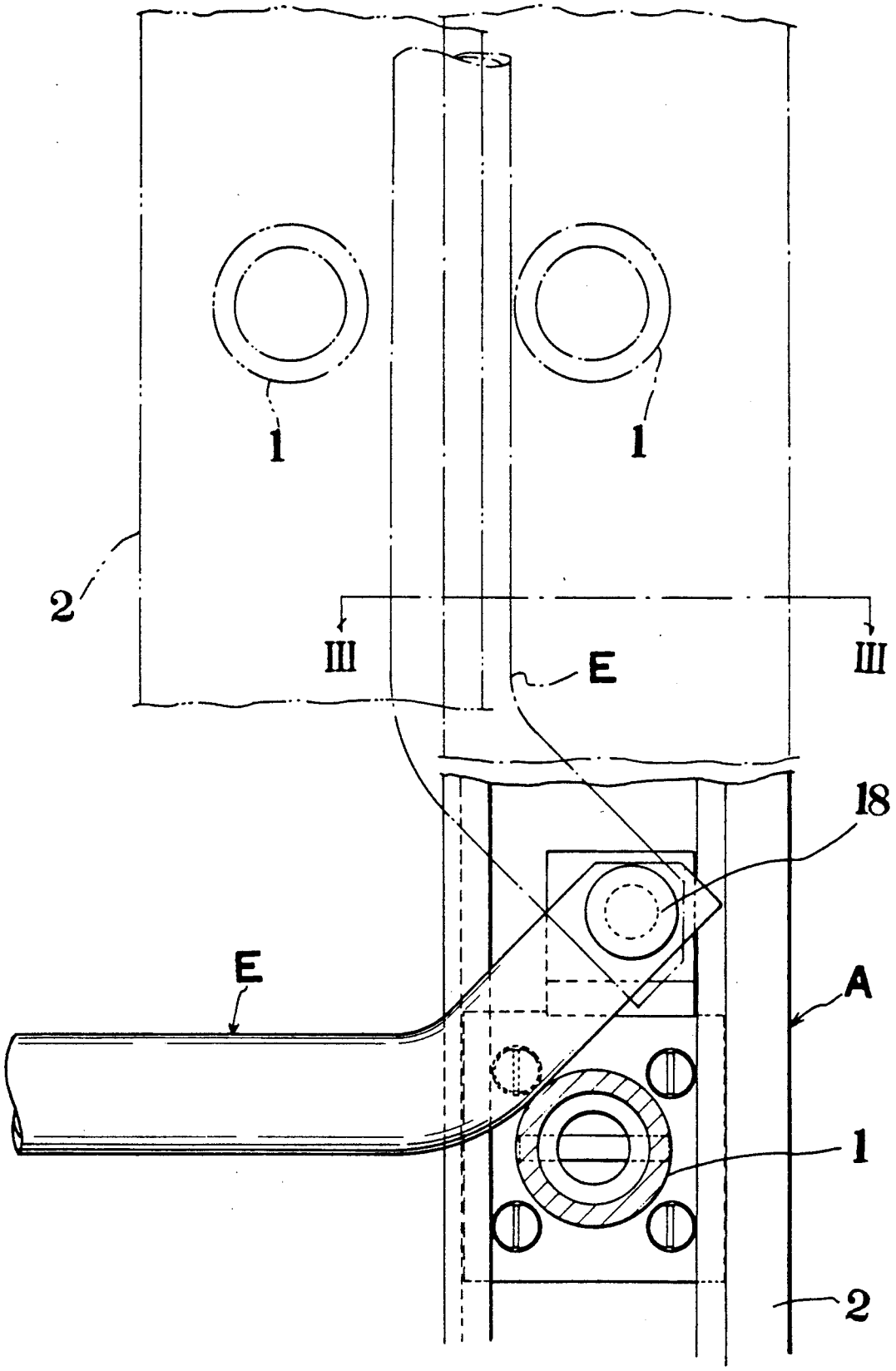
FIG. 9 is an enlarged sectional side view partly showing the safety guard device in an operated position.

On the contrary, corresponding to the sliding-down movement of each ladder member $A_1, A_2 \ldots, A_6$, as shown in FIG. 8 and FIG. 9 with a solid line, the safety guard device E is rotated almost 90 degrees toward outside to take a horizontal position. In this position, the safety guard device E can surround the back of the man climbing down the complete ladder M so as to prevent him from falling down.

In this embodiment, preferably, the operating wire 11 may be provided with an alarm system which is operated for preventing a robber from going into the room of the building X making use of the emergency ladder of this invention.

The following describes the second embodiment shown in FIGS. 12 through 16.

This embodiment is different from the first embodiment in that the ladder connecting devices B are disposed at the top of the ladder section 2 of each ladder member $A_1, A_2 \ldots, A_6$.

Figure 12:
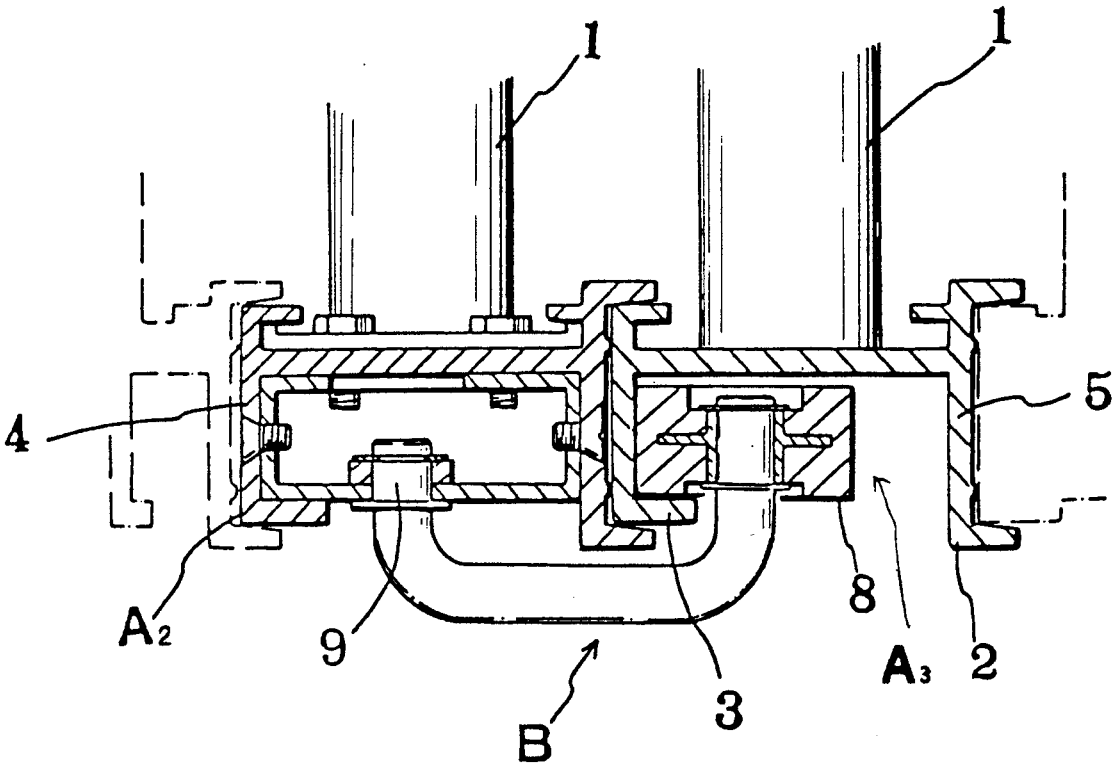
FIG. 12 is a cross sectional view in FIG. 13 showing the structure of right-side portions of the stacked ladder members of the second embodiment.
Figure 16:
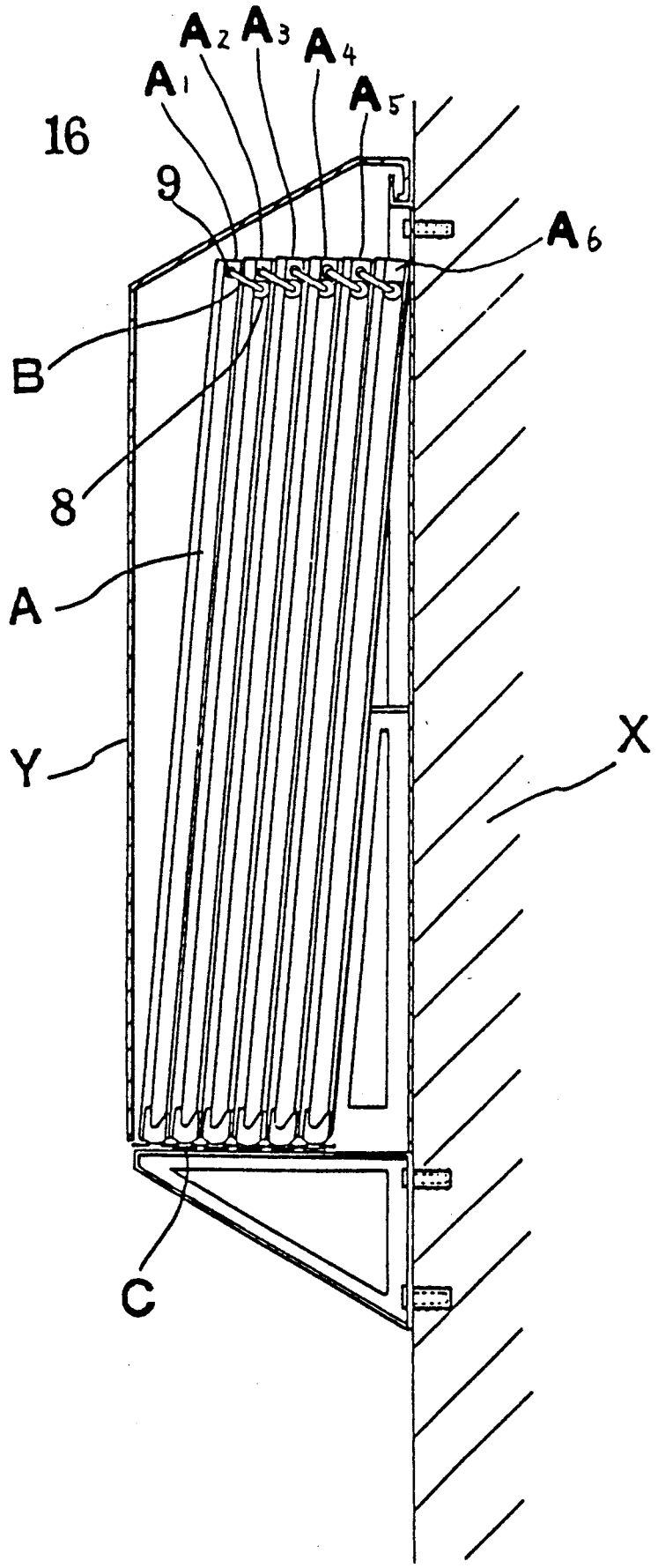
FIG. 16 is a sectional side view showing a condition where ladder members are stored in a storage case in the second embodiment.

To be more specific, as shown in FIG. 16 and FIG. 12, one end of the U-shaped connector 7 is pivotally mounted on the top of the preceeding ladder member (for example $A_2$), while the support roller 8 which is pivoted to the other end of the connector 7 is slidably disposed inside of the succeeding ladder member (for example $A_2$). When the preceeding ladder member $A_2$ slides down, the support roller 8 also runs down inside the ladder section 2 of the succeeding ladder member $A_3$ and the preceeding ladder member $A_2$ reaches to the bottom end of the ladder section 2 of the succeeding ladder member $A_3$ to be suspended from the succeeding ladder member $A_3$ by the U-shaped connector 7.

Figure 13:
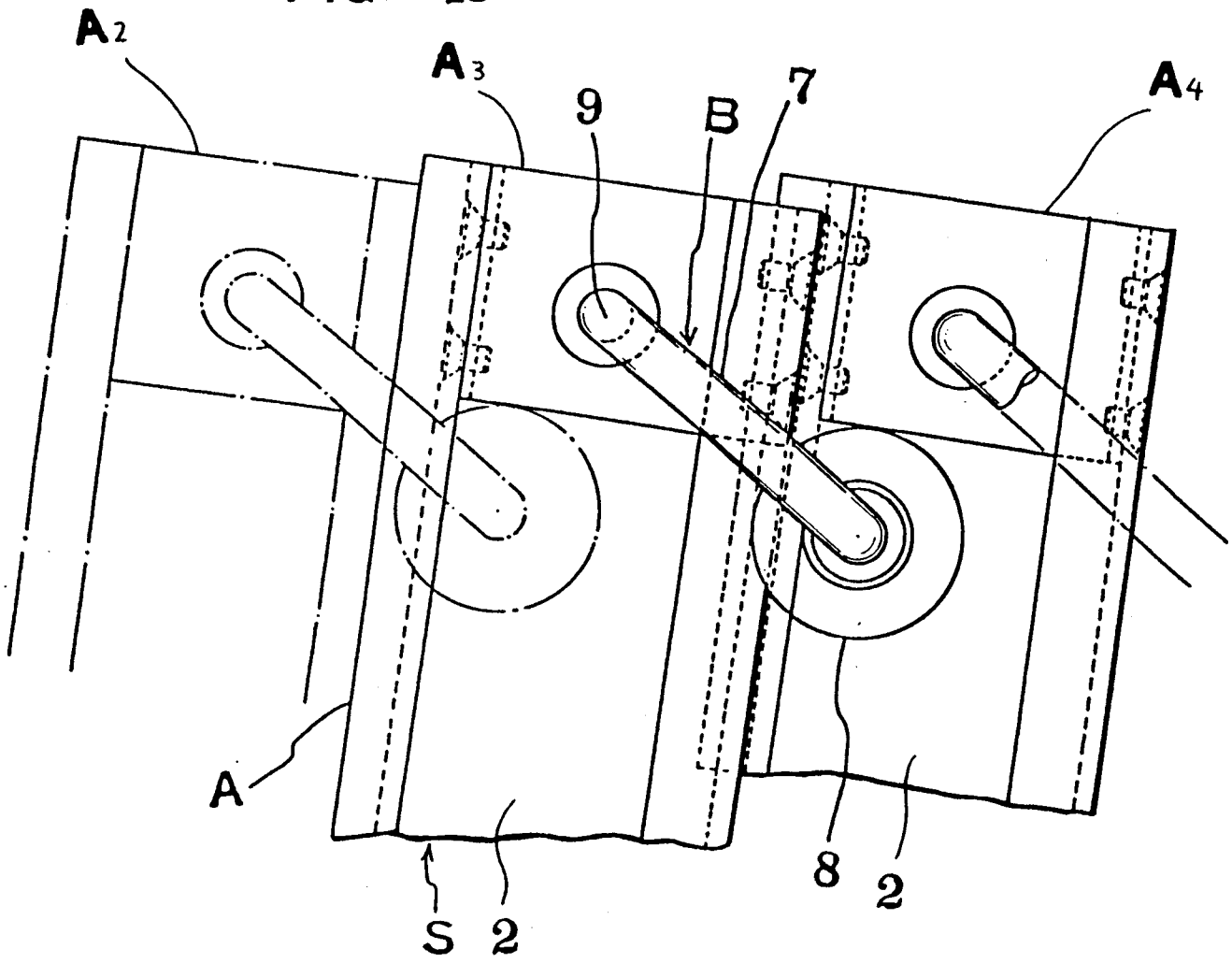
FIG. 13 is a side view partly showing the stacked ladder members and the ladder connecting devices for connecting stacked ladder members in the second embodiment.

In FIG. 12 and FIG. 13, the essential portions of the emergency ladder of this embodiment is shown, wherein FIG. 12 shows the structure of the right-side portions of the stacked ladder members $A_1, A_2 \ldots, A_6$, while FIG. 13 shows the enlarged top part of stacked ladder members $A_1, A_2 \ldots, A_6$ connected by the ladder connecting devices B.

Figure 14:
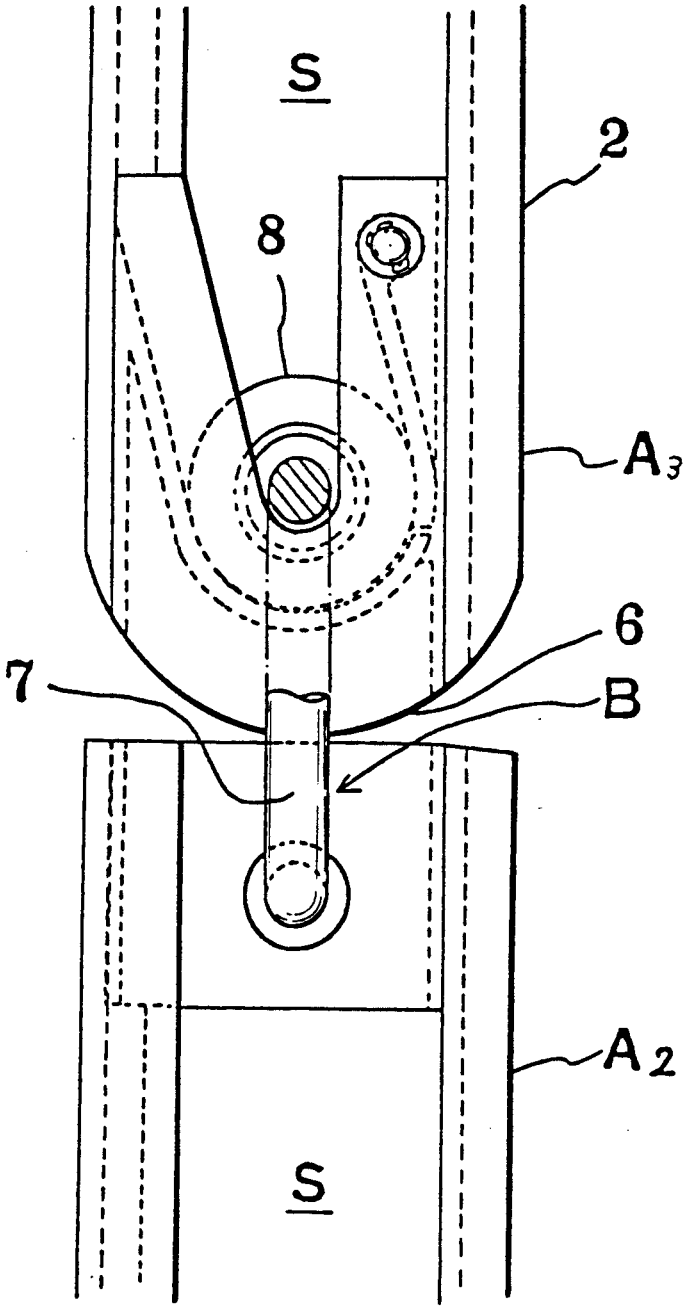
FIG. 14 is an enlarged view partly showing a condition where two ladder members are connected by the ladder connecting devices in the second embodiment.

FIG. 14 shows a condition that the preceeding ladder member $A_1$ is suspended to the adjacent succeeding ladder member $A_2$ as a result of the sliding-down movement of the preceeding ladder member $A_1$, wherein the support roller 8 is disposed inside the bottom end of the succeeding ladder member $A_2$ and the preceeding ladder member $A_1$ is connected to the succeeding ladder member $A_2$ by the U-shaped connector 7.

Figure 15:
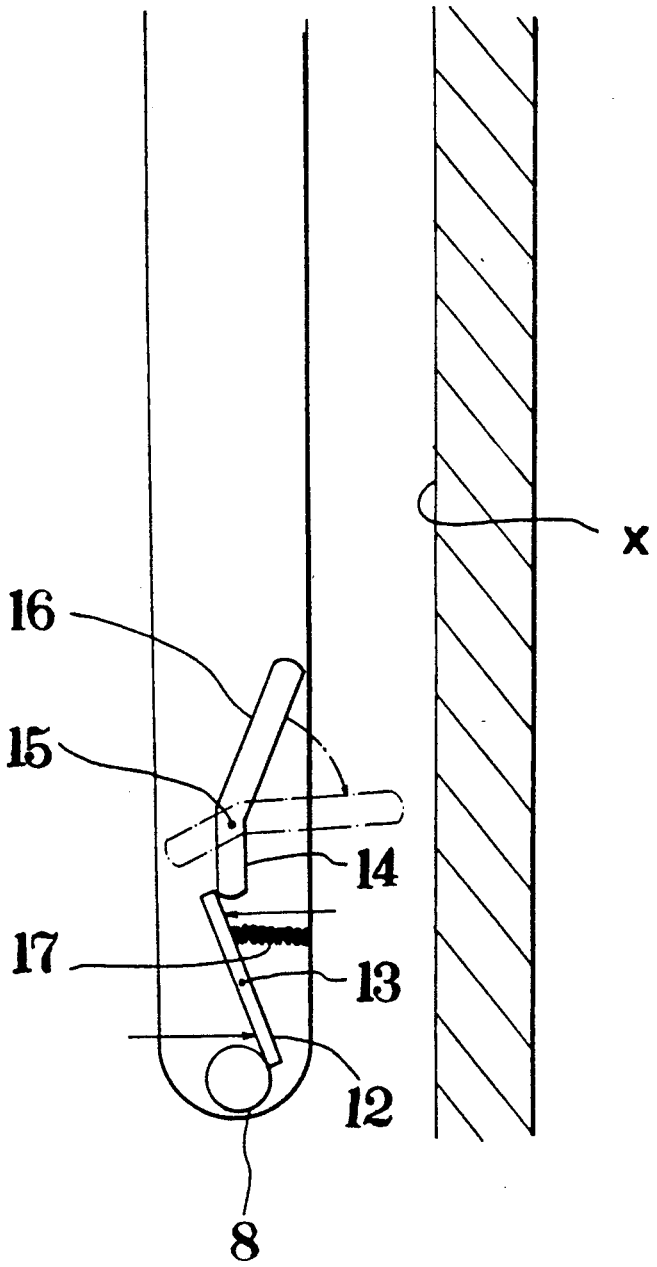
FIG. 15 is a side view schematically showing the spacing device in an operated position.

FIG. 15 shows the construction of the spacing device D schematically.

At the bottom end of the ladder section 2 of the ladder member (for example $A_3$), the stopper 12 is pivotally mounted on the middle part of the ladder section 2, wherein the upper end of the stopper 12 is engaged with the engaging portion 14 of the spacer 16 which is pivotable on a shaft 15. Numeral 17 indicates the spring which biases the stopper 12 toward the engaging portion 14.

Accordingly, when the preceeding ladder member (for example $A_2$) slides down from the starage case Y, the support roller 8 runs down through the inside of the ladder section 2 of the adjacent succeeding ladder member $A_3$ and the stopper 12, the engaging portion 14 and the spacer 16 are operated one after another by the running support roller 8.

The manner in which the emergency ladder explained heretofore in view of two embodiments is described hereinafter.

Except for an emergency case, each ladder member $A_1, A_2 \ldots, A_6$ A is stored in the storage case Y under a stacked condition (see FIG. 11) and is held kept on the support stays 10 which are horizontally pivotally mounted on the support arms 9 projected from the outside wall x of the building X and the first stay 10' is connected with the operating wire 11 which can be operated from the window at every floor in the building X.

In an emergency, when the operating wire 11 is pulled, the first stay 10' which is connected with the operating wire 11 is rotated to horizontally swing the first stay 10' toward the outside of the storage case Y to release the frontmost ladder member $A_1$ (the first ladder member) enabling the frontmost ladder member $A_1$ to slide down from the storage case Y. As the frontmost ladder member $A_1$ slides down, the ladder connecting device B which connects the frontmost ladder member $A_1$ and the second ladder member $A_2$ is rotated downwardly to operate the second stay 10 which supports the second ladder member $A_2$ to release the second stay 10 so that the the second ladder member $A_2$ slides down from the storage case Y in the same manner as the above-mentioned frontmost ladder member $A_1$.

At last, all the ladder members $A_1, A_2 \ldots, A_6$ slide down from the storage case Y while every ladder member $A_1, A_2 \ldots, A_6$ are connected one after another vertically to form the complete ladder M along the outside wall x of the building X.

At the same time, corresponding to the sliding-down movement of the ladder members $A_1, A_2 \ldots, A_6$, the spacing device D is operated and provides a sufficient space between the complete ladder M and the outside wall x of the building M by the spacer 16 thereby preventing a man climbing down the complete ladder M from suffering the smoke and fire blowing out from the window and simultaneouly the safety guard device E is operated to surround the back of the man thereby preventing the man from falling down.

To recapitulate the advantage of the present invention, the complete ladder is easily formed by pulling the wire from each window of a building and the ladder structure for sliding down a plurality of ladder members is simple and easy to operate, accordingly the emergency ladder of this invention functions effectively in emergency cases at highrise buildings.

Whereas the drawing and the accompanying description have shown and described two preferred embodiments of the present invention, it should be apparent to those skilled in the art that various changes may be made in the form of the invention without affecting the scope thereof.

For example, the number of the ladder members are not limited to the number described in the specification and it can be increased or reduced depending on the height of the building and other constructional or architectural factors.

We Claim:

1. Emergency ladder equipment comprising;

(a) a plurality of ladder members which form a complete ladder by being vertically suspended one after another, (b) a storage case storing said ladder members under a stacked condition, said storage case mounted on an uppermost portion of an outside wall of a building, (c) a plurality of ladder connecting devices each of which connects perpendicularly the bottom end of a preceeding ladder member and the top end of the lower ladder member, and (d) a plurality of support stays which support the bottom of said respective ladder members in said storage case and release the bottom end of each ladder member by a suitable means release means, whereby by releasing said support stays from the bottom end of the ladder members and making the first ladder member slide down from said storage case, other ladder members slide down one after another and said all ladder members are suspended in series while being connected by said connecting devices to form a complete ladder.

2. Emergency ladder equipment according to claim 1 in which said emergency ladder equipment is provided with a spacing device to provide a space between said complete ladder and the outside wall of said building and said spacing device is operated automatically corresponding to the slide-down movement of said ladder members from said storage case.

3. Emergency ladder equipment according to claim 1 in which said emergency ladder equipment is provided with a safety guard device which is capable of surrounding the back of a man who climbs down said complete ladder to escape from fire.

* * * * *